US008375855B2

(12) United States Patent
Atwood et al.

(10) Patent No.: US 8,375,855 B2
(45) Date of Patent: Feb. 19, 2013

(54) DEVICE FOR CLEANING THE IOWA ROLL ON A DUPLEXING MARKING SYSTEM

(75) Inventors: Mark A Atwood, Rush, NY (US); James J Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 205 days.

(21) Appl. No.: 12/754,768

(22) Filed: Apr. 6, 2010

(65) Prior Publication Data

US 2011/0239881 A1 Oct. 6, 2011

(51) Int. Cl.
*B41F 35/00* (2006.01)

(52) U.S. Cl. ..... 101/425; 101/483

(58) Field of Classification Search ..... 101/425
See application file for complete search history.

(56) References Cited

U.S. PATENT DOCUMENTS 4,765,242 A * 8/1988 Oya et al. ..... 101/425
4,833,530 A * 5/1989 Kohashi ..... 358/502
4,889,560 A 12/1989 Jaeger et al.
5,389,950 A 2/1995 Bouton
5,389,958 A 2/1995 Bui et al.
5,991,564 A 11/1999 Ni
6,091,925 A * 7/2000 Sugimoto et al. ..... 399/327
6,176,575 B1 * 1/2001 Crawford et al. ..... 347/103
6,278,860 B1 * 8/2001 Morganti et al. ..... 399/327
6,432,211 B1 * 8/2002 Schmitt et al. ..... 134/6
6,532,353 B1 * 3/2003 Orchard et al. ..... 399/327
6,799,000 B2 9/2004 Aslam et al.
7,798,587 B2 * 9/2010 Mizes et al. ..... 347/8
2003/0209158 A1 * 11/2003 Porat ..... 101/425

* cited by examiner

*Primary Examiner* — Anthony Nguyen
(74) *Attorney, Agent, or Firm* — Ronald E. Prass, Jr.; Prass LLP

(57) ABSTRACT

This is a paper web transporting component that is useful in a duplexing system that uses a paper web to be imaged. The unit has an IOWA roller (backup roll) with an image sensor above it and a cleaning web structure below it. Since excess toner or ink in duplexing systems can adhere to the transport roll, the sensor will pick up these impurities when scanning the surface of the paper web. Therefore, these impurities must be removed from the transport roll or scanning for proper image registration will be adversely affected. The movement of the paper web causes the transport roll to rotate so that the sensor can scan the entire surface of the transport roll.

14 Claims, 3 Drawing Sheets

DEVICE FOR CLEANING THE IOWA ROLL ON A DUPLEXING MARKING SYSTEM

This invention relates to toner or direct marking systems and, more specifically, to rollers in a duplexing marking system.

BACKGROUND

The term "IOWA" relates to Image On Web Array as used in duplexing marking systems. While the present invention will be described as used in direct marking printing systems, it is equally applicable and useful in electrophotographic duplexing systems.

The use of an array of print heads in ink-jet printing is well known in the art as disclosed in co-pending application Ser. No. 11/773,549. Briefly, direct marking printing comprises ejecting ink droplets from orifices in a print head onto some type of receiving media to form a desired image. Generally, this formed image comprises a grid-like pattern of drop locations usually referred to as pixels. Often, the image resolution is indicated by the number of ink drops or dots per inch (dpi) commonly having a resolution of from about 300 dpi to about 600 dpi. The disclosure of above application Ser. No. 11/773,549 details this ink-jet process precisely and is totally incorporated by reference into the present disclosure.

U.S. Pat. No. 5,389,958, assigned to the assignee of the present application, is an example of an indirect or offset printing architecture that utilizes phase change ink. The ink is applied to an intermediate transfer surface in molten form having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web such as a sheet of paper media is then fed into the transfer nip and the ink image is transferred to the final receiving web.

Inks usable in the present invention are like those described in U.S. Pat. Nos. 5,389,958 and 4,889,560. The disclosures of U.S. Pat. Nos. 5,389,950 and 4,889,560 are also incorporated by reference into the present disclosure. U.S. Pat. No. 5,389,958 indicates "the ink used to form the ink image preferably must have suitable specific properties for viscosity". Initially, the viscosity of the molten ink must be matched to the requirements of the ink-jet device utilized to apply it to the intermediate transfer surface and optimized relative to other physical and rheological properties of the ink as a solid, such as yield strength, hardness, elastic modulus, loss modulus, ratio of the loss modulus to the elastic modulus and ductility. The viscosity of the phase change ink carrier composition has been measured on a Ferranti-Shirley Cone Plate Viscometer with a large cone. At about 140° C. (older version of ink, the current is 120° C.), a preferred viscosity of the phase change ink carrier composition is from about 5 to about 30 centipoises, more preferably from about 10 to about 20 centipoises and most preferable from about 11 to 15 centipoises. The surface tension of suitable inks is between about 23 and about 50 dynes/centimeters.

As noted in the above-referenced prior art patents, the usable ink also used in the present invention is in a solid phase at ambient temperature and in a liquid phase at elevated operating temperatures.

Cleaning webs for toner-using marking systems are known in the art such as those disclosed in U.S. Pat. No. 6,799,000, patent application Ser. No. 12/512,279 and Ser. No. 12/336, 791. The cleaning web used in the present invention can have the same or similar compositions and forms as these prior art cleaning webs.

Duplexing marking systems are also known such as those disclosed in U.S. Pat. No. 5,991,564. All of the above patents and patent applications are incorporated by reference into the present disclosure.

While running the web (paper) in duplex or mobius mode, ink transferring from the web onto the IOWA backup roll has been observed. This creates a condition of annular streaks buildup onto the roll. The IOWA sensor which is located directly over the roll has the ability to read through the web media which results in detection of these annular streaks promoting false registration measurements into the system. Current strategy for resolution requires cleaning or replacement of the roll when this scenario occurs creating undesirable downtime to the customer and added costs.

SUMMARY

This invention proposes introducing an active cleaning element onto the backup roll. This is achieved by contacting the roller surface with a web blanket. The web blanket makeup is a fabric base which is very similar to above-noted cleaning webs of past practices used on the fuser roll. The engaged surface area of the two components (roller and web) creates a scrubbing or wiping action which will lift the ink deposits off the roller onto the web blanket and transport them onto the take-up roll of the web-cleaning mechanism. The web-cleaning mechanism will be integrated into the frame structure of the IOWA backup roll to allow for customer operability/service actions.

The present invention provides introducing an active cleaning element onto the backup roll. This is achieved by contacting the roller surface with a web blanket. The web blanket makeup as above noted is a fabric base which is very similar to past practices used on the fuser roll. The engaged surface area of the two components (roller and web) create a scrubbing or wiping action which will lift the ink deposits off the roller onto the web blanket and transport them onto the take-up roll of the web-cleaning mechanism. The web-cleaning mechanism will be integrated into the frame structure of the IOWA backup roll to allow for customer operability/service actions. The present invention could be used on any rolls in a duplexing marking system but is especially needed for the optical sensor backup roll to ensure accurate readings. The IOWA backup roll is used to keep the paper web properly positioned with respect to the IOWA sensor as it passes through the marking system. This is especially critical in color systems where image alignment is necessary for final image quality.

It is important to the present invention that the gap between the IOWA backup roll and the sensor be maintained at a distance that allows proper reading of the images by the sensor. If the gap is out of the proper distance, irregular and imprecise readings will be taken by the sensor. Thus, it is important that at least one of the sensor or IOWA backup roll be adjustable so that the precise focal length for the sensor be always maintained. The cleaning web contacts or blankets the IOWA backup roll at the bottom portion of the IOWA roll. After the cleaning of the IOWA backup roll by the cleaning web, the cleaning web proceeds to a take-up roll where it is discarded after use. Once the IOWA roll is cleaned of the toner impurities, the sensor can read the image properly for image alignment purposes or for future processing. This "IOWA Unit" i.e. sensor, IOWA backup roll and cleaning web can be easily retrofitted into existing duplexing marking systems if desired.

The cleaning web is moved by any suitable web drive mechanism which in one embodiment causes a web pulling action on the web after the cleaning step and winds the used web around the cleaning web take-up roll. Generally, for best results this IOWA backup roll is cleaned at its bottom portion that is located between an isolation roller and the cleaning web take-up roll. The IOWA backup roll is moved by the contact with the paper web that passes over the IOWA backup roll at its upper portion between the IOWA backup roll and the sensor.

DETAILED DISCUSSION OF DRAWINGS AND PREFERRED EMBODIMENTS

Figure 1:
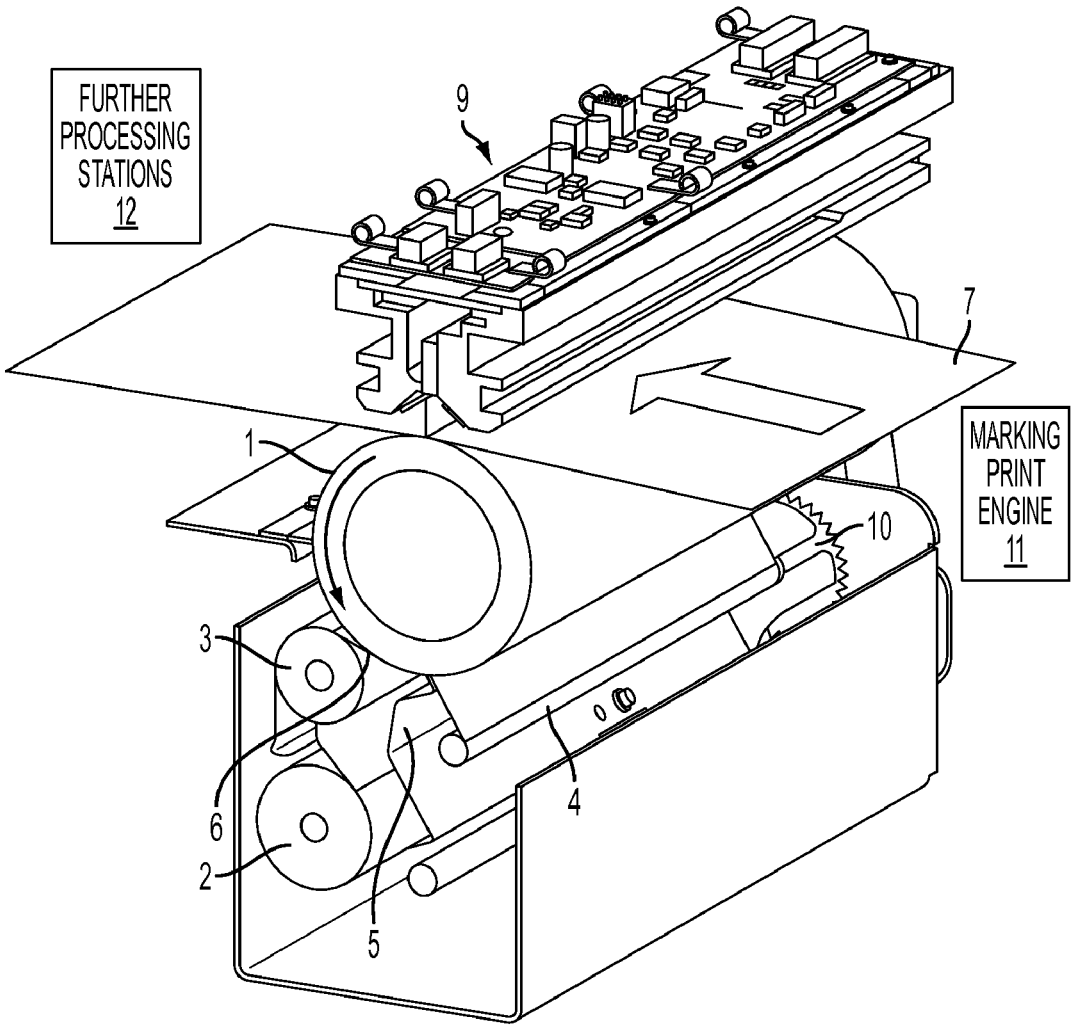
FIG. 1 is a perspective side view of an embodiment of the optical sensor backup roll unit used in the invention.

In FIG. 1, mounted parallel and underneath of the rotating IOWA backup roll 1 is the cleaning web device. This device is comprised of a cleaning supply roll 2, isolation roll 3, take-up roll 4 and baffle 5 to create an engaged wraparound 6 IOWA backup roll. The supply roll 2 is pre-wrapped with the web blanket 6. The web blanket 6 is threaded around the isolation roll 3 over the baffle radius and terminated onto the take-up roll 4. The isolation roller 3 is a spring-loaded element which creates an upward force resulting in a lifting of the web blanket 6 onto the IOWA backup roll 1 resulting in the contact wrap angle. The take-up roller 4 is motorized and includes a motor system 10, and rotates the roller such that it wraps the web blanket 6 onto the roller 1.

The IOWA backup roll is rotated via the friction drive force of the paper web 7. The cleaning blanket motion, as described above, is delivered via the take-up roller rotation. The drag or friction force that is induced between the two surfaces will be light enough so as not to create a stalled condition of the IOWA backup roll 1. The friction force created by the two differential velocity vectors will create the light-scrubbing action required to lift off the deposited ink buildup impurities 8 (see FIG. 2) on the roller 1. An IOWA sensor 9 senses the image 13 (see FIG. 2) and provides feedback for proper position for subsequent registration. However, the sensor 9 will also pick up the annular streaks 8 impurities on the reverse side of the paper web 7 which promotes false registration measurements into the system.

Figure 2:
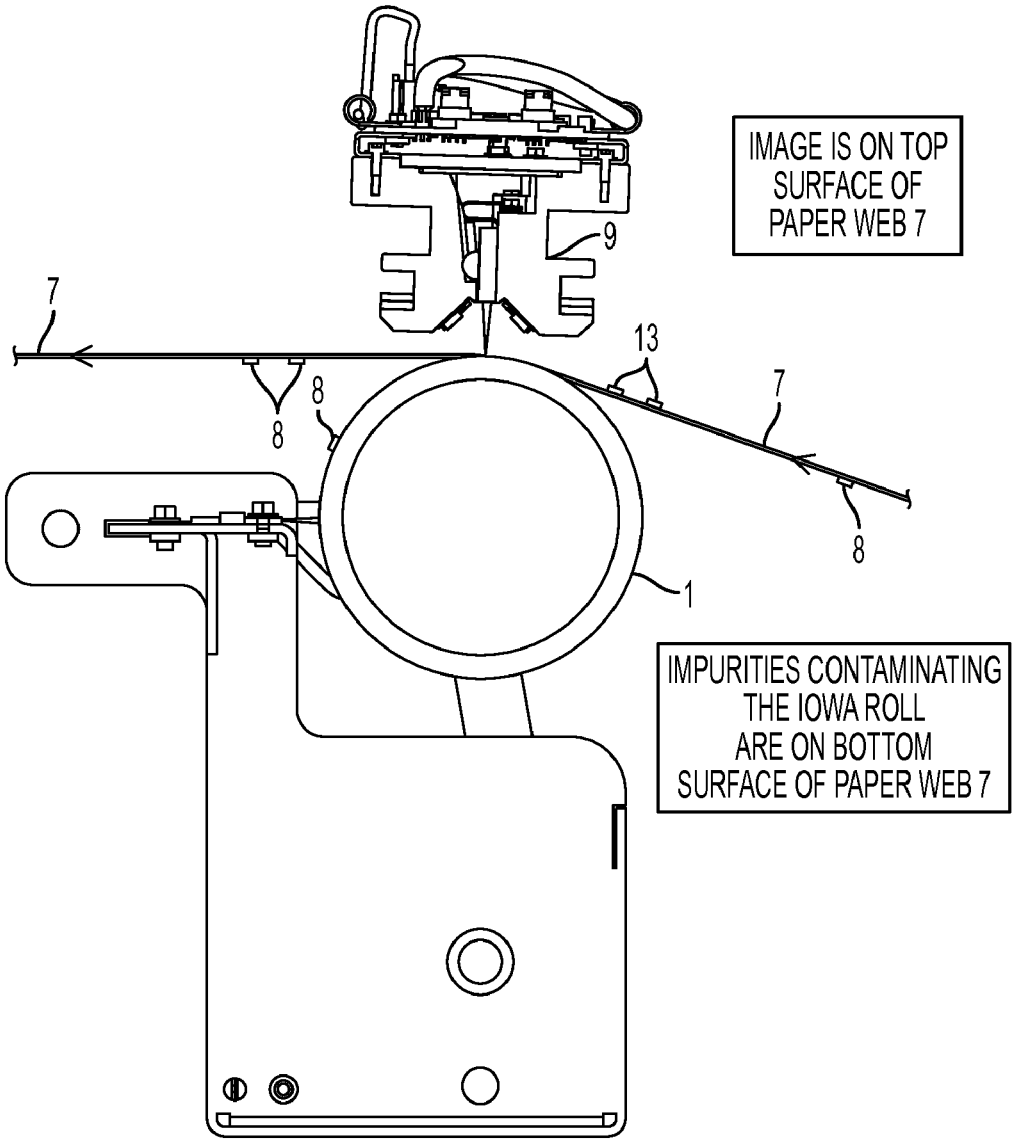
FIG. 2 is a plan view of the backup roll unit showing the locations of the image developer and the locations of the residual impurities that require cleaning.

In FIG. 2, the positioning of the images 13 and impurities 8 are shown before the web 6 cleans the impurities 8 off the paper web 7. The cleaning web and other lower components (shown in FIG. 1) are not shown in FIG. 2. Once the impurities 8 contact IOWA backup roll 1, they are cleaned off IOWA backup roll 1 by the cleaning web 6 as shown in FIG. 1. The impurities 8 contaminating the IOWA backup roll 1 are read by sensor 9 and conveyed to a controller which activates the cleaning web 6 and removes these contaminants 8 from the roller 1. The present system can be used in any type marking system where a sensor is used to read an image that passes between a roller and the sensor.

Figure 3:
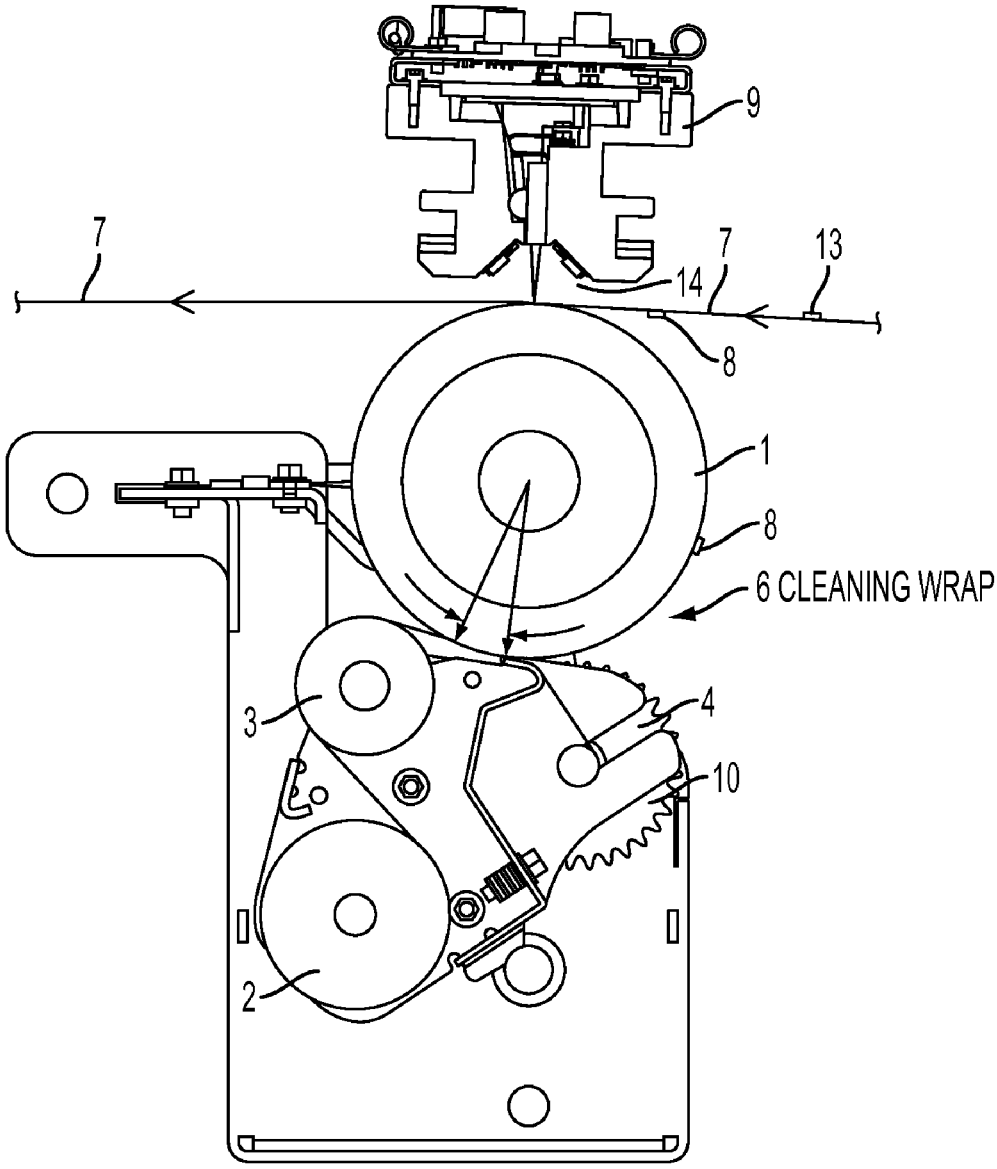
FIG. 3 is a plan side view of the optical sensor backup roll unit and sensor of an embodiment of this invention.

In FIG. 3, the IOWA backup roll 1 maintains the gap 14 and position between roll 1 and sensor 9 so that the focal length is maintained for proper functioning of the reading of the sensor 9. If the focal length exceeds the proper distance or is under the proper distance, the image becomes blurry and the sensor 9 reading is imprecise. Once the impurities 8 are removed by the cleaning web 6 and the focal length is proper, the sensor readings of the images 13 are precise and the paper web 7 can move on for further processing. The IOWA roll 1 and sensor 9 unit are positioned in the marking system after the print engine 11 and before the further processing stations or the cutting or the collection stations 12 as shown in FIG. 1.

In summary, this invention provides an IOWA unit (a paper transporting unit) useful in a duplexing marking system comprising a sensor, an IOWA backup roll and a cleaning web. This IOWA backup roll (roll) is configured to permit an imaged paper web to travel over and in contact with the roll, giving motion to the roll. The IOWA backup roll is positioned under the sensor and forms the required gap between the roll and the sensor. This cleaning web is positioned at a place below the roll and provides a cleaning surface or blanket that is configured to contact a bottom section of the roll to continuously clean the entire rotating roll. The IOWA unit is positioned in the marking system between a marking print engine and subsequent processing components. These components are positioned at a point after the marking print engine and after the cleaning of the roll.

The cleaning web of this unit comprises a cleaning web supply roll, an isolation spring-loaded roller and a cleaning web take-up roll. The gap is configured to be adjustable by adjusting movement of either or both the roll or the sensor. The roll is rotated by contact of the roll with a moving paper web which is configured to continuously contact an upper section of the roll to provide rotation movement to the roll.

The cleaning web comprises as components a cleaning web supply roll, a spring-loaded isolation roller and a cleaning web take-up roll. At least one of these components is connected to a web drive mechanism which is configured to induce continuous movement of the cleaning web against a bottom section of the roll. The unit is configured to be retrofitted into any suitable duplexing marking system. The unit is configured to clean the roll of impurities caused on the roll by contact with impurities formed on a lower face of the paper web.

Also provided by this invention is a method of cleaning a paper web transport roll (IOWA backup roll) in a marking duplexing system which comprises positioning a sensor above the IOWA backup roll (roll), thereby forming a gap between an upper section of the IOWA backup roll and the sensor. Also, an IOWA backup roll cleaning web is positioned on a plane below the IOWA backup roll, continuously passing the cleaning web in a cleaning step into contact with a lower section of the IOWA backup roll to thereby clean the IOWA backup roll of toner or developer impurities to thereby provide a substantially cleaned IOWA backup roll that contacts a lower section of the paper web. The cleaned IOWA backup roll passes the cleaning web subsequently in the cleaning step to a cleaning web take-up roll. This take-up roll and a cleaning web supply roll are configured together or individually to be moved by a web drive mechanism.

In this method, the cleaning web comprises a cleaning web supply roll, an isolation spring-loaded roller and a cleaning web take-up roll. The gap is established by positioning of the IOWA backup roll under the sensor. The roll is rotated by contact of the roll with a moving paper web. This paper web is configured to contact an upper section of the roll to provide rotation movement to the roll. In this method, the cleaning web comprises as components a cleaning web supply roll, a spring-loaded isolation roller and a cleaning web take-up roll. At least one of these components is connected to a web drive mechanism which is configured to induce movement of the cleaning web against a bottom section of the roll. The unit used in this method is configured to be retrofitted into a suitable duplexing marking system. This method is configured to clean the roll of impurities caused on the roll by contact with impurities formed on a lower face of the paper web.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An IOWA unit useful in a duplexing marking system comprising:

a sensor, an IOWA backup roll, a cleaning web, and a marking print engine, said IOWA backup roll (roll) configured to permit a paper web to travel over and in contact with said roll, said roll is docked against said sensor forming a desired gap between said roll and said sensor, said cleaning web positioned at a place below said roll, and providing a cleaning surface or blanket that is configured to contact and clean a bottom section of said roll, said IOWA unit positioned in said system after the marking print engine in a process direction.

2. The unit of claim 1 wherein said cleaning web comprises a cleaning web supply roll, an isolation spring-loaded roller and a cleaning web take-up roll.

3. The unit of claim 1 wherein said gap is established by docking of said roll against said sensor.

4. The unit of claim 1 wherein said roll is rotated by contact of said roll with a moving paper web, said paper web configured to contact an upper section of said roll to provide rotation movement to said roll.

5. The unit of claim 1 wherein said cleaning web comprises as components a cleaning web supply roll, a spring-loaded isolation roller and a cleaning web take-up roll, at least one of said components connected to a web drive mechanism which is configured to induce movement of said cleaning web against a bottom section of said roll.

6. The unit of claim 1 which is configured to be retrofitted into a suitable duplexing marking system.

7. The unit of claim 1 which is configured to clean said roll of impurities caused on said roll by contact with impurities formed on a lower face of said paper web.

8. A method of cleaning a paper web transport roll (IOWA backup roll) of a marking duplexing system which comprises:

positioning a roll below an IOWA sensor (sensor) thereby forming a gap between an upper section of said IOWA roll and said sensor, positioning an IOWA backup roll cleaning web on a plane below said IOWA backup roll, continuously passing said cleaning web in a cleaning step into contact with a lower section of said IOWA backup roll to thereby clean said IOWA backup roll of toner or developer impurities thereby providing a substantially cleaned IOWA backup roll to contact a lower section of said paper web, passing said cleaning web subsequently to said cleaning step to a cleaning web take-up roll, said take-up roll and a cleaning web supply roll configured to be moved by a web drive mechanism.

9. The method of claim 8 wherein said cleaning web comprises a cleaning web supply roll, an isolation spring-loaded roller and a cleaning web take-up roll.

10. The method of claim 8 wherein said gap is established by positioning of said roll under said sensor.

11. The method of claim 8 wherein said roll is rotated by contact of said roll with a moving paper web, said paper web configured to contact an upper section of said roll to provide rotation movement to said roll.

12. The method of claim 8 wherein said cleaning web comprises as components a cleaning web supply roll, a spring-loaded isolation roller and a cleaning web take-up roll, at least one of said components connected to a web drive mechanism which is configured to induce movement of said cleaning web against a bottom section of said roll.

13. The method of claim 8 which is configured to be retrofitted into a suitable duplexing marking system.

14. The method of claim 8 which is configured to clean said roll of impurities caused on said roll by contact with impurities formed on a lower face of said paper web.

* * * * *